US008016030B1

(12) United States Patent
Prado Garcia

(10) Patent No.: US 8,016,030 B1
(45) Date of Patent: Sep. 13, 2011

(54) APPARATUS AND METHOD FOR CONTAINING OIL FROM A DEEP WATER OIL WELL

(75) Inventor: Jose Jorge Prado Garcia, San Diego, CA (US)

(73) Assignee: triumUSA, Inc., San Diego, CA (US)

( * ) Notice: Subject to any disclaimer, the term of this patent is extended or adjusted under 35 U.S.C. 154(b) by 0 days.

(21) Appl. No.: 12/875,080

(22) Filed: Sep. 2, 2010

Related U.S. Application Data

(60) Provisional application No. 61/357,498, filed on Jun. 22, 2010.

(51) Int. Cl.
*E21B 43/01* (2006.01)

(52) U.S. Cl. ..... 166/75.13; 166/345; 166/352; 166/364; 166/367; 166/79.1; 166/97.1; 405/64; 405/224.2

(58) Field of Classification Search ..... 166/75.13, 166/339, 345, 352, 356, 359, 363, 364, 367–369, 166/379, 380, 79.1, 81.1, 97.1; 405/224, 405/224.2; 138/155
See application file for complete search history.

(56) References Cited

U.S. PATENT DOCUMENTS

| | | | | | |
|---|---|---|---|---|---|
| 1,858,241 | A | * | 5/1932 | Giles | 166/95.1 |
| 1,859,606 | A | * | 5/1932 | Sieven et al. | 166/79.1 |
| 3,657,895 | A | | 4/1972 | Phelps | |
| 3,686,877 | A | | 8/1972 | Bodin | |
| 3,698,198 | A | | 10/1972 | Phelps | |
| 3,815,682 | A | * | 6/1974 | Chiasson et al. | 169/49 |
| 3,879,951 | A | | 4/1975 | Mason | |
| 4,127,005 | A | | 11/1978 | Osborne | |
| 4,318,442 | A | * | 3/1982 | Lunde et al. | 166/357 |
| 4,323,118 | A | * | 4/1982 | Bergmann | 166/96.1 |
| 4,358,218 | A | * | 11/1982 | Graham | 405/60 |
| 4,395,157 | A | | 7/1983 | Cunningham | |
| 4,416,565 | A | * | 11/1983 | Ostlund | 210/170.11 |
| 4,456,071 | A | * | 6/1984 | Milgram | 166/356 |
| 4,545,437 | A | | 10/1985 | Denison | |
| 4,568,220 | A | * | 2/1986 | Hickey | 405/60 |
| 4,661,016 | A | | 4/1987 | Baugh et al. | |
| 5,012,854 | A | * | 5/1991 | Bond | 166/363 |
| 5,012,865 | A | | 5/1991 | McLeod | |
| 5,107,931 | A | * | 4/1992 | Valka et al. | 166/342 |
| 5,113,948 | A | * | 5/1992 | Richardson | 169/49 |
| 5,152,346 | A | * | 10/1992 | Wilson | 169/52 |
| 5,154,234 | A | * | 10/1992 | Carrico | 169/46 |
| 5,159,983 | A | * | 11/1992 | Barron et al. | 166/379 |
| 5,238,071 | A | * | 8/1993 | Simpson | 169/47 |

(Continued)

FOREIGN PATENT DOCUMENTS

| | | |
|---|---|---|
| DE | 4116130 | 11/1992 |

(Continued)

*Primary Examiner* — Thomas A Beach
*Assistant Examiner* — Matthew Buck
(74) *Attorney, Agent, or Firm* — Clause Eight IPS; Michael Catania

(57) ABSTRACT

An apparatus and method for containing oil from a deep water (greater than 1,000 meters) oil well is disclosed herein. The apparatus has an anchor section, a plurality of riser sections, an upper section and a flow tube. A pressure within the apparatus is equal to a pressure outside of the apparatus to prevent collapse of the apparatus, and to prevent crystallization. Oil is suctioned from the interior of the apparatus through the flow tube to a surface of the ocean.

15 Claims, 9 Drawing Sheets

U.S. PATENT DOCUMENTS

| | | | | |
|---|---|---|---|---|
| 5,484,024 | A * | 1/1996 | Ladd et al. | 166/369 |
| 5,921,321 | A * | 7/1999 | Sepich | 166/379 |
| 6,119,772 | A * | 9/2000 | Pruet | 166/81.1 |
| 6,176,317 | B1 * | 1/2001 | Sepich | 166/379 |
| 6,817,417 | B2 * | 11/2004 | Blair et al. | 166/335 |
| 7,578,349 | B2 | 8/2009 | Sundararajan et al. | |
| 7,674,073 | B2 | 3/2010 | Heskin et al. | |
| 2009/0200039 | A1 * | 8/2009 | Murphy et al. | 166/378 |

FOREIGN PATENT DOCUMENTS

| | | |
|---|---|---|
| DE | 4126540 | 2/1993 |
| FR | 2675533 | 10/1992 |
| FR | 2676090 | 11/1992 |
| GB | 2254552 | 10/1992 |
| JP | 05311976 | 11/1993 |
| JP | 06026293 | 2/1994 |
| WO | WO81/00875 | 4/1981 |

* cited by examiner

APPARATUS AND METHOD FOR CONTAINING OIL FROM A DEEP WATER OIL WELL

CROSS REFERENCE TO RELATED APPLICATION

The Present Application claims priority to U.S. Provisional Patent Application No. 61/357,498, filed on Jun. 22, 2010, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention generally relates to deep water oil wells. More specifically, the present invention relates to an apparatus and method for containing oil from a deep water oil well.

2. Description of the Related Art

The prior art discusses various methods for containing oil from a damaged oil well, including a damaged deep water oil well.

One example is Reynolds, U.S. Pat. No. 7,690,433 for a Modular, Distributed, ROV Retrievable Subsea Control System, Associated Deepwater Subsea Blowout Prevent Stack Configuration, And Methods of Use, which discloses a device for containing a damaged deep water oil well.

According to TransOcean, a well drilled at a vertical depth of 35,050 ft (10,683 m) and measured depth of 35,055 ft (10,685 m) has a pressure of 10,4865 kPa (kilo Pascals) as drilled and 10,4885 kPA as measured, or 15,209 psi and 15,212 psi, respectively.

The ocean floor of the location of some deep water oil wells is 1500 meters, 2400 meters or more. The hydrostatic pressure at these depths is over 1500 kPAs. At these depths, methane hydrate crystals can form and block or hinder containment efforts. The crystallization is one of the problems that must be overcome for containing damaged deep water oil wells.

It is important to contain oil from a damaged oil well and to prevent contamination of the ocean water and shore line. Further, it is important to construct an oil well in a manner that can prevent leakage of crude oil if the oil well is damaged in the future.

BRIEF SUMMARY OF THE INVENTION

The present invention provides a solution for containing oil from a deep water oil well. More specifically, the present invention provides a solution for preventing oil spills from deep water oil wells and for containing oil from a damaged deep water oil well. The present invention is a new, innovative technology for the containment and redirection of oil from a deepwater oil well. The novel apparatus and method for containing oil from a deepwater oil well is either applied to a damaged well, or constructed as a preventative safety measure when drilling a new well. The present invention works by containing the spilling crude in a multi-staged, modular containment stack, equipped with remote controlled anti-blow out valves to equalize interior and exterior pressure. The flowing crude is then directed from the containment stack through a connected flow-tube to surface tankers for storage, thereby containing the oil and protecting the underwater ecosystem.

One aspect of the present invention is an apparatus for containing oil from a damaged deep water oil well. The apparatus has an anchor section, multiple riser sections, multiple gasket sections, an upper section and a flow tube. The anchor section anchors the apparatus to a sea-floor. The anchor section includes a base portion for positioning in the sea-floor and an anchor wall extending upward from the base portion. The anchor wall includes a body with a top end. A first gasket section is mounted on the top end of the body of the anchor wall of the anchor section. A first riser section includes first riser wall, a first inlet valve and a first outlet valve. The first riser wall has a body and a top end. The first inlet valve is opposite the first outlet valve. The first riser section is connected to the first gasket section. A second gasket is mounted on the top end of the first riser wall. A second riser section includes a second riser wall, a second inlet valve and a second outlet valve. The second riser wall has a body and a top end. The second inlet valve is opposite the second outlet valve. The second riser section is connected to the second gasket section. A third gasket is mounted on the top end of the second riser wall. A third riser section includes a third riser wall, a third inlet valve and a third outlet valve. The third riser wall has a body and a top end. The third inlet valve is opposite the third outlet valve. The third riser section is connected to the third gasket section. The upper section has a base portion and an enclosure portion. The base portion is mounted on the top end of the third riser wall of the third riser section. The enclosure portion has an aperture. The flow tube is in flow communication with an interior of the apparatus through the aperture of the enclosure portion of the upper section. A pressure within the apparatus is equal to a pressure outside of the apparatus. Oil is suctioned from the interior of the apparatus through the flow tube.

Another aspect of the present invention is a method for constructing an apparatus for preventing an oil spill from a deep water oil well. The method includes determining an anchoring position a predetermined distance from a drilled deep water oil well or a potential deep water oil well, wherein the predetermined distance ranges from 2 meters to 10 meters. The method also includes anchoring an anchor section of an apparatus for containing oil from a damaged deep water oil well in a sea floor at the anchoring position. The anchor section comprises a base portion for positioning in the sea-floor and an anchor wall extending upward from the base portion. The anchor wall also comprises a body with a top end. The method also includes mounting a first gasket on the top end of the anchor wall of the anchor section. The method also includes mounting a first riser section on the first gasket. The first riser section comprises a first riser wall, a first inlet valve and a first outlet valve. The first riser wall has a body and a top end. The first inlet valve is opposite the first outlet valve. The method also includes adjusting the first inlet valve and the first outlet valve to equalize a pressure within the first riser section and outside of the first riser section. The method also includes mounting a second gasket on the top end of the first riser wall of the first riser section. The method also includes mounting a second riser section on the second gasket. The second riser section comprises a second riser wall, a second inlet valve and a second outlet valve. The second riser wall has a body and a top end. The second inlet valve is opposite the second outlet valve. The method also includes adjusting the second inlet valve and the second outlet valve to equalize a pressure within the second riser section and outside of the second riser section. The method also includes mounting a third gasket on the top end of the second riser wall of the second riser section. The method also includes mounting a third riser section on the third gasket. The third riser section comprises a third riser wall, a third inlet valve and a third outlet valve. The third riser wall has a body and a top end. The third inlet valve is opposite the third outlet valve. The method also includes adjusting the third inlet valve and the third outlet valve to equalize a pressure within the third riser section and outside of the third riser section. The method also includes capping the apparatus with an upper section having a base portion and an enclosure portion. The base portion is mounted on the top end of the third riser wall of the third riser section. The enclosure portion has an aperture in flow communication with a flow tube. The method also includes optionally drilling the oil well if the oil well has not yet been drilled. The method also includes suctioning oil from an interior of the apparatus through the flow tube. The method also includes equalizing a pressure within the apparatus to a pressure outside of the apparatus by suctioning oil/water at a predetermined vacuum and adjusting each of the valves.

Another aspect of the present invention is a method for constructing an apparatus for containing oil from a damaged deep water oil well. The method includes determining an anchoring position a predetermined distance from a damaged deep water oil well, wherein the predetermined distance ranges from 2 meters to 10 meters. The method also includes anchoring an anchor section of an apparatus for containing oil from a damaged deep water oil well in a sea floor at the anchoring position. The anchor section comprises a base portion for positioning in the sea-floor and an anchor wall extending upward from the base portion. The anchor wall also comprises a body with a top end. The method also includes mounting a first gasket on the top end of the anchor wall of the anchor section. The method also includes mounting a first riser section on the first gasket. The first riser section comprises a first riser wall, a first inlet valve and a first outlet valve. The first riser wall has a body and a top end. The first inlet valve is opposite the first outlet valve. The method also includes adjusting the first inlet valve and the first outlet valve to equalize a pressure within the first riser section and outside of the first riser section. The method also includes mounting a second gasket on the top end of the first riser wall of the first riser section. The method also includes mounting a second riser section on the second gasket. The second riser section comprises a second riser wall, a second inlet valve and a second outlet valve. The second riser wall has a body and a top end. The second inlet valve is opposite the second outlet valve. The method also includes adjusting the second inlet valve and the second outlet valve to equalize a pressure within the second riser section and outside of the second riser section. The method also includes mounting a third gasket on the top end of the second riser wall of the second riser section. The method also includes mounting a third riser section on the third gasket. The third riser section comprises a third riser wall, a third inlet valve and a third outlet valve. The third riser wall has a body and a top end. The third inlet valve is opposite the third outlet valve. The method also includes adjusting the third inlet valve and the third outlet valve to equalize a pressure within the third riser section and outside of the third riser section. The method also includes capping the apparatus with an upper section having a base portion and an enclosure portion. The base portion is mounted on the top end of the third riser wall of the third riser section. The enclosure portion has an aperture in flow communication with a flow tube. The method also includes suctioning oil from the interior of the apparatus through the flow tube. The method also includes equalizing a pressure within the apparatus to a pressure outside of the apparatus by suctioning oil at a predetermined vacuum and adjusting each of the valves.

Yet another aspect of the present invention is an apparatus for preventing an oil spill from a deep water oil well, with the apparatus having an anchor section, a plurality of riser sections, an upper section and a flow tube. The anchor section anchors the apparatus to a sea-floor around an oil well or a potential oil well. If the oil well has not yet been drilled, the drilling may occur after construction of the apparatus or during construction of the apparatus. The anchor section comprises a base portion for positioning in the sea-floor and an anchor wall extending upward from the base portion. The anchor wall comprises a body with a top end. Each of the plurality of riser sections comprises a riser wall, an inlet valve and an outlet valve. Each riser wall has a body and a top end. The inlet valve is opposite the outlet valve. A first riser section of the plurality of riser sections is positioned on the anchor section. The upper section has a base portion and an enclosure portion. The base portion is mounted on the top end of the riser wall of a last riser section of the plurality of riser sections. The enclosure portion has an aperture. The flow tube is in flow communication with an interior of the apparatus through the aperture of the enclosure portion of the upper section. A pressure within the apparatus is equal to a pressure outside of the apparatus. Oil is suctioned from the interior of the apparatus through the flow tube.

Yet another aspect of the present invention is an apparatus for containing oil from a damaged deep water oil well, with the apparatus having an anchor section, a plurality of riser sections, an upper section and a flow tube. The anchor section anchors the apparatus to a sea-floor. The anchor section comprises a base portion for positioning in the sea-floor and an anchor wall extending upward from the base portion. The anchor wall comprises a body with a top end. Each of the plurality of riser sections comprises a riser wall, an inlet valve and an outlet valve. Each riser wall has a body and a top end. The inlet valve is opposite the outlet valve. A first riser section of the plurality of riser sections is positioned on the anchor section. The upper section has a base portion and an enclosure portion. The base portion is mounted on the top end of the riser wall of a last riser section of the plurality of riser sections. The enclosure portion has an aperture. The flow tube is in flow communication with an interior of the apparatus through the aperture of the enclosure portion of the upper section. A pressure within the apparatus is equal to a pressure outside of the apparatus. Oil is suctioned from the interior of the apparatus through the flow tube.

Yet another aspect of the present invention is a method for containing oil from a damaged deep water oil well. The method includes identifying a damaged deep water oil well. The method also includes constructing an apparatus for containing oil from the damaged deep water oil well. The apparatus includes an anchor section, a plurality of riser sections, an upper section and a flow tube. The anchor section anchors the apparatus to a sea-floor. The anchor section comprises a base portion for positioning in the sea-floor and an anchor wall extending upward from the base portion. The anchor wall comprises a body with a top end. Each of the plurality of riser sections comprises a riser wall, an inlet valve and an outlet valve. Each riser wall has a body and a top end. The inlet valve is opposite the outlet valve. A first riser section of the plurality of riser sections is positioned on the anchor section. The upper section has a base portion and an enclosure portion. The base portion is mounted on the top end of the riser wall of a last riser section of the plurality of riser sections. The enclosure portion has an aperture. The flow tube is in flow communication with an interior of the apparatus through the aperture of the enclosure portion of the upper section. The method also includes equalizing an interior pressure of the apparatus with an exterior pressure. The method also includes suctioning oil from an interior of the apparatus through the flow tube.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
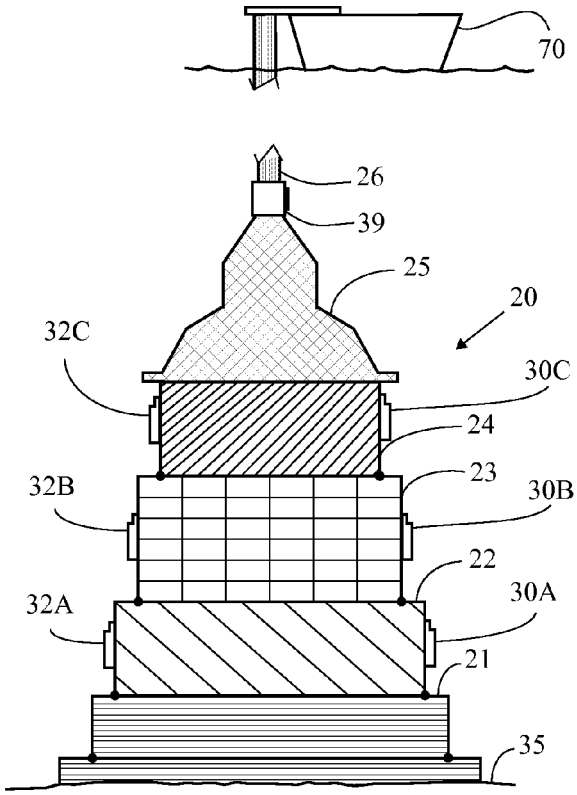
FIG. 1 is a front view of an apparatus for containing oil from a deep water oil well.
Figure 1A:
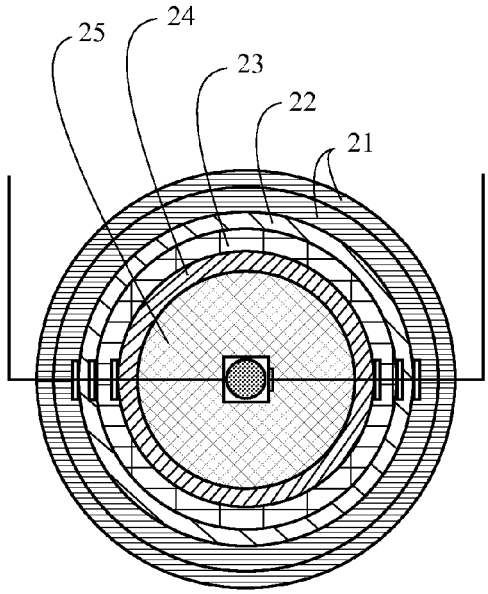
FIG. 1A is a top plan view of the apparatus of FIG. 1.

As shown in FIGS. 1 and 1A, an apparatus for containing oil from a deep water oil well is generally designated 20. The apparatus 20 is preferably anchored to a seabed or ocean floor 55. In a most preferred embodiment, the apparatus 20 is anchored to the ocean floor 55 at more than 1,500 meters below an ocean surface.

The apparatus 20 is in flow communication with a pump 70 located at the surface through a flow tube 26. The apparatus 20 preferably comprises an anchor section 21, a plurality of riser sections 22, 23 and 24, and an upper section 25. Each of the plurality of riser sections 22, 23 and 24 has an inlet valve 30 and an outlet valve 32. The inlet valves 30 allow sea water to flow into an interior of the apparatus 20 while the outlet valves 32 allow oil and sea water to exit the interior of the apparatus 20. The inlet valves 30 and outlet valves 32 assist in equalizing the pressure of the interior of the apparatus 20 with the exterior pressure at the great depths of the ocean floor 55.

Figure 6:
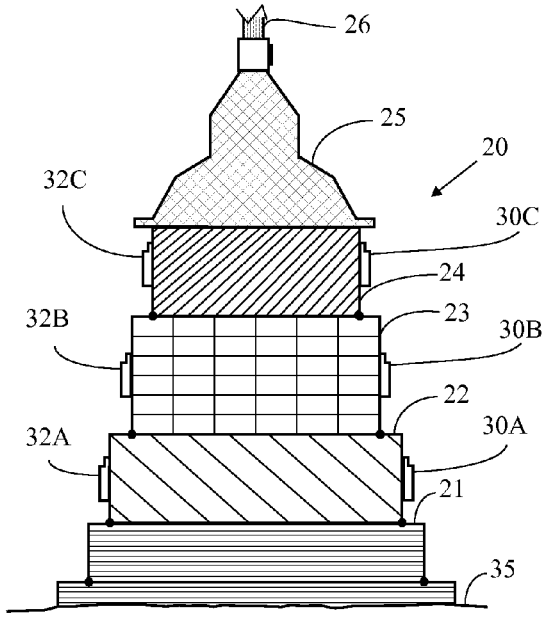
FIG. 6 is a front view of the anchor section, first riser section, second riser section, third riser section and upper section of the partially constructed apparatus.
Figure 6A:
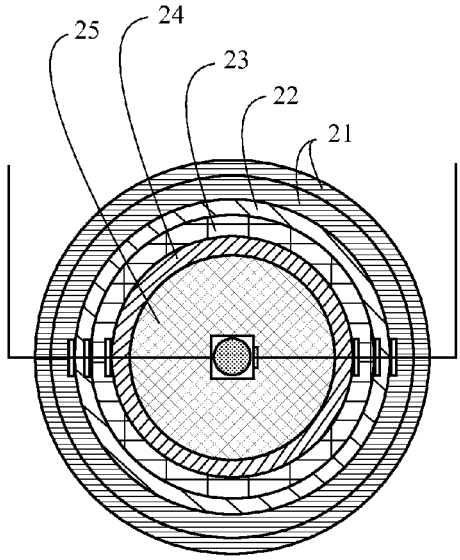
FIG. 6A is a top plan view of the anchor section, first riser section, second riser section, third riser section and upper section of the partially constructed apparatus of FIG. 6.
Figure 6B:
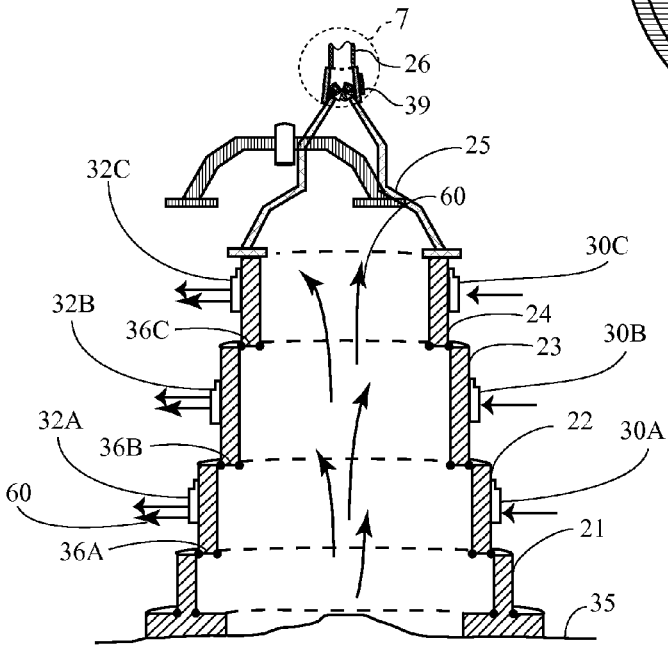
FIG. 6B is a cross-sectional view along line B-B of FIG. 6A.

As shown in FIG. 6B, oil 60 from a damaged oil well 50 is contained within the apparatus 20 instead of floating to the surface and contaminating the ocean surface and shoreline. Those skilled in the pertinent art will recognize that the apparatus 20 can be built around a damaged well structure or the damaged well structure is removed as shown in FIG. 6B. An oil well typically has a diameter of approximately 530 millimeters. Further, the apparatus can be built as an apparatus for an undamaged oil well or a potential oil well, in order to prevent contamination from an oil spill from an oil well.

Figure 2:
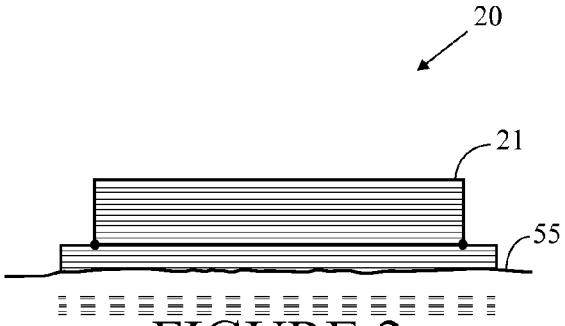
FIG. 2 is a front view of an anchor section of the partially constructed apparatus.
Figure 2A:
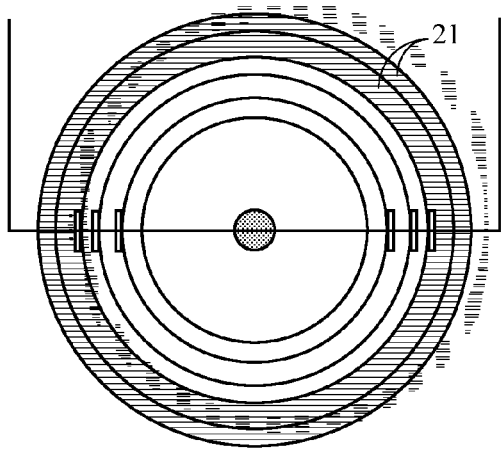
FIG. 2A is a top plan view of the anchor section of the partially constructed apparatus of FIG. 2.
Figure 2B:
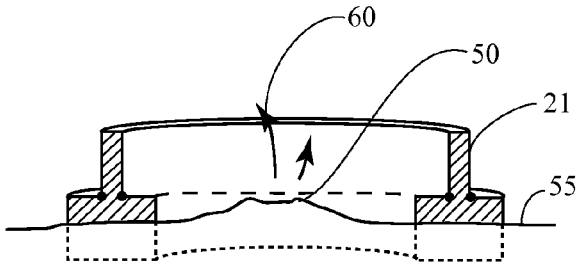
FIG. 2B is a cross-sectional view along line B-B of FIG. 2A.

In constructing the apparatus 20, the location of the oil well 50 is located and a distance from the oil well 50 is determined for the anchoring position of the anchor section 21 of the apparatus 20. Further, in an alternative embodiment, the anchoring position is around a potential oil well, with the drilling of the oil well occurring after or during construction of the apparatus 20. The anchoring position is preferably 1 meter to 10 meters from an edge of the oil well 50. A base portion of the anchoring section 21 is anchored into the ocean floor 55 to secure the apparatus 20 to the ocean floor 55. As shown in FIG. 2B, the base portion is preferably anchored below a surface of the ocean floor 55. An anchor wall of the anchor section 21 is mounted on base portion. U.S. Pat. No. 4,674,918 discloses deep water anchoring and U.S. Pat. No. 4,674,918 is hereby incorporated by reference in its entirety.

Figure 3:
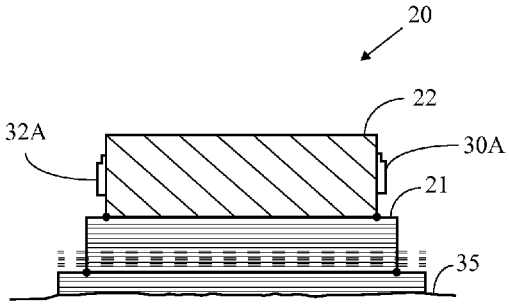
FIG. 3 is a front view of an anchor section and first riser section of the partially constructed apparatus.
Figure 3A:
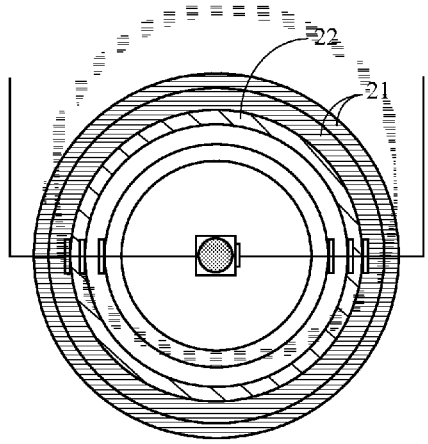
FIG. 3A is a top plan view of the anchor section and first riser section of the partially constructed apparatus of FIG. 3.
Figure 3B:
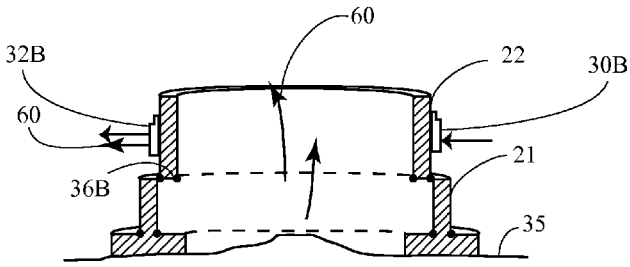
FIG. 3B is a cross-sectional view along line B-B of FIG. 3A.

Next in constructing the apparatus, as shown in FIGS. 3, 3A and 3B, a first riser section 22 is mounted on the anchor section 21. The first riser section 21 is preferably mounted on a first gasket 36A which is positioned on a top end of the anchor wall of the anchoring section 21. The first gasket 36A prevents leaks between the anchor section 21 and the first riser section 22. The first riser section 22 has a first inlet valve 30A and a first outlet valve 32A. The first inlet valve 30A allows sea water into the interior of the apparatus 20 while the first outlet valve 32A allows oil and sea water out of the interior of the apparatus 20. The first inlet valve 30A and the first outlet valve 32A equalize the pressure within the interior of the apparatus 20 with the exterior pressure of the ocean floor 55 to prevent a collapse of the apparatus 20 and crystallization from forming on the apparatus 20. The first inlet valve 30A and the first outlet valve 32A are preferably placed in an open position during the construction of the apparatus 20. The first inlet valve 30A and the first outlet valve 32A are preferably controlled via wireless communication, however those skilled in the pertinent art will recognize that a wired communication may be utilized for transmitting control functions to the first inlet valve 30A and the first outlet valve 32A. In utilizing wireless communication, a submersible robot vehicle is preferably utilized to assist in the transmission of commands from a control vehicle on the ocean surface.

Figure 4:
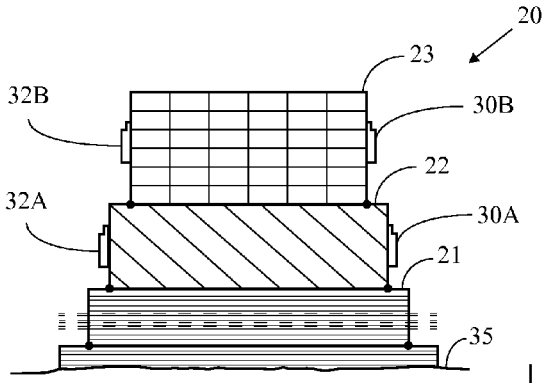
FIG. 4 is a front view of an anchor section, first riser section and second riser section of the partially constructed apparatus.
Figure 4A:
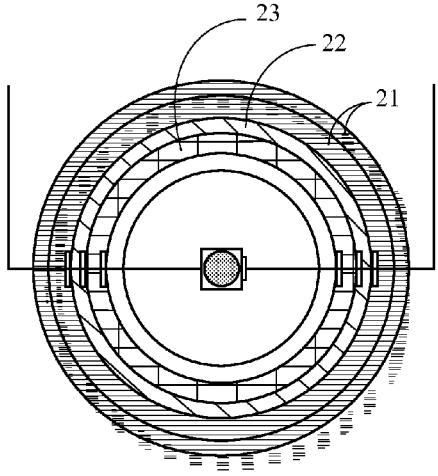
FIG. 4A is a top plan view of the anchor section, first riser section and second riser section of the partially constructed apparatus of FIG. 4.
Figure 4B:
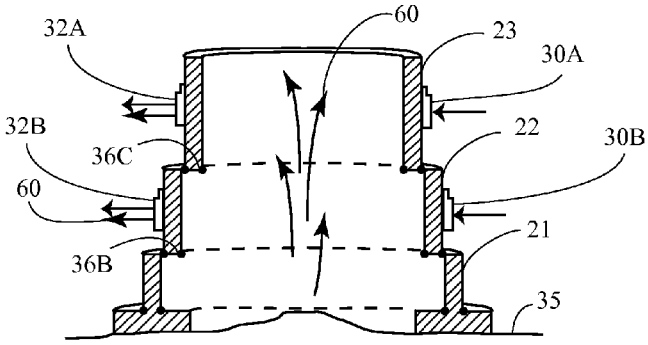
FIG. 4B is a cross-sectional view along line B-B of FIG. 4A.

Next in constructing the apparatus, as shown in FIGS. 4, 4A and 4B, a second riser section 23 is mounted on the first riser section 22. The second riser section 23 is preferably mounted on a second gasket 36B which is positioned on a top end of a riser wall of the first riser section 22. The second gasket 36B prevents leaks between the first riser section 22 and the second riser section 23. The second riser section 23 has a second inlet valve 30B and a second outlet valve 32B. The second inlet valve 30B allows sea water into the interior of the apparatus 20 while the second outlet valve 32B allows oil and sea water out of the interior of the apparatus 20. The second inlet valve 30B and the second outlet valve 32B equalize the pressure within the interior of the apparatus 20 with the exterior pressure of the ocean floor 55 to prevent a collapse of the apparatus 20 and crystallization from forming on the apparatus 20. The second inlet valve 30B and the second outlet valve 32B are preferably placed in an open position during the construction of the apparatus 20. The second inlet valve 30B and the second outlet valve 32B are preferably controlled via wireless communication, however those skilled in the pertinent art will recognize that a wired communication may be utilized for transmitting control functions to the second inlet valve 30B and the second outlet valve 32B.

Figure 5:
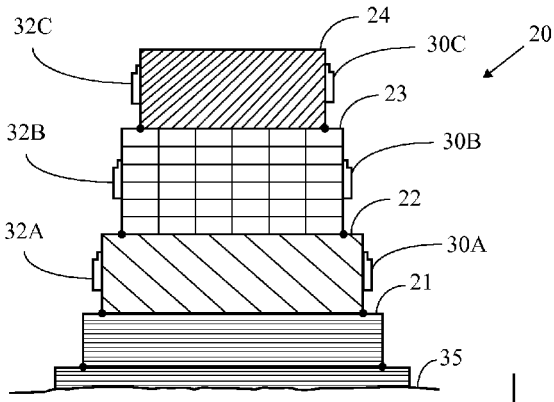
FIG. 5 is a front view of the anchor section, first riser section, second riser section, and third riser section of the partially constructed apparatus.
Figure 5A:
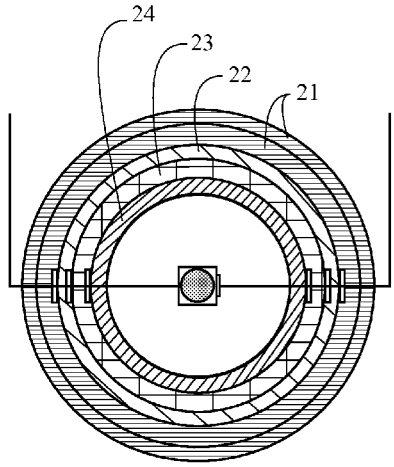
FIG. 5A is a top plan view of the anchor section, first riser section, second riser section, and third riser section of the partially constructed apparatus of FIG. 5.
Figure 5B:
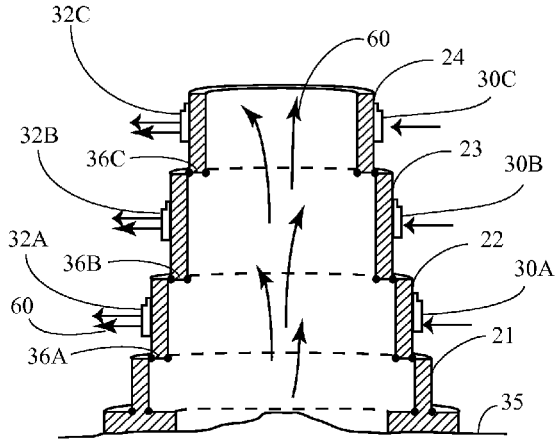
FIG. 5B is a cross-sectional view along line B-B of FIG. 5A.

Next in constructing the apparatus, as shown in FIGS. 5, 5A and 5B, a third riser section 24 is mounted on the second riser section 23. The third riser section 24 is preferably mounted on a third gasket 36C which is positioned on a top end of a riser wall of the second riser section 23. The third gasket 36C prevents leaks between the second riser section 23 and the third riser section 24. The third riser section 24 has a third inlet valve 30C and a third outlet valve 32C. The third inlet valve 30C allows sea water into the interior of the apparatus 20 while the third outlet valve 32C allows oil and sea water out of the interior of the apparatus 20. The third inlet valve 30C and the third outlet valve 32C equalize the pressure within the interior of the apparatus 20 with the exterior pressure of the ocean floor 55 to prevent a collapse of the apparatus 20 and crystallization from forming on the apparatus 20. The third inlet valve 30C and the third outlet valve 32C are preferably placed in an open position during the construction of the apparatus 20. The third inlet valve 30C and the third outlet valve 32C are preferably controlled via wireless communication, however those skilled in the pertinent art will recognize that a wired communication may be utilized for transmitting control functions to the third inlet valve 30C and the third outlet valve 32C.

Figure 7:
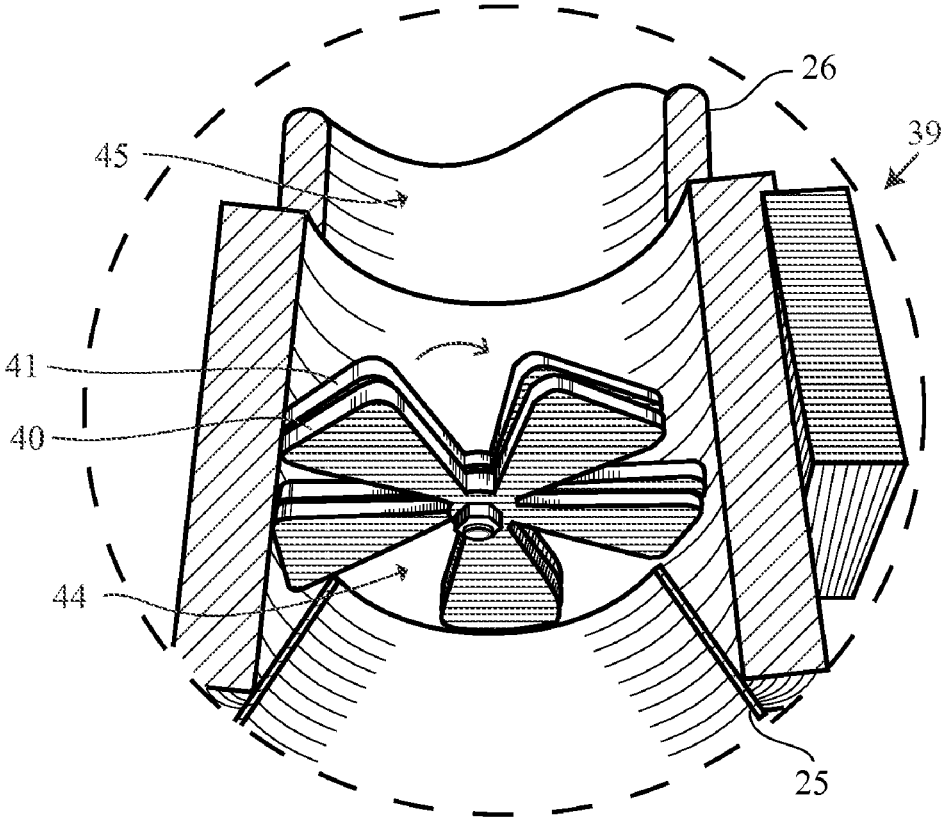
FIG. 7 is an enlarged view of circle 7 of FIG. 6B, illustrating a top valve assembly for the apparatus.

Next in constructing the apparatus 20, as shown in FIGS. 6, 6A and 6B, an upper section 25 is mounted on the third riser section 24. The upper section 25 is preferably mounted on a top end of a riser wall of the third riser section 24. The upper section 25 has a base portion and an enclosure portion. The enclosure portion has an aperture, preferably located at an apex of the enclosure portion, for connection with the flow tube 26. The flow tube 26 allows for flow communication between the interior of the apparatus 20 and the pump 70 which suctions oil from the damaged oil well 50 to the surface of the ocean. As shown in FIG. 7, the upper section 26 has a valve assembly 39 which comprises a valve 40 having a movable valve wall 41 and a fixed valve wall 44. The valve 40, through operation of the movable valve wall 41, can be set to a closed state, an open state or a partially open state. The valve 40 is in an open state as shown in FIG. 7. The state of the valve 40 controls the flow of oil and water through a chamber 45 of the upper section. Adjusting valve 40 also assists in controlling the pressure in the apparatus 20 and allows for the flow tube 26 to be cut-off in case of maintenance or an emergency. Closing the valve 40 allows the flow tube 26 to suction all of the crude oil within the flow tube 26 for maintenance or an emergency without having to modify the apparatus 20.

Each of the anchor section 21, the first riser section 22, the second riser section 23, the third riser section 24 and the upper section 25, is preferably composed of a concrete material capable of withstanding the high hydrostatic pressures at depths of at least 1500 meters and capable of withstanding effects of salt water. The upper section 25, or other sections alternatively are composed of other materials such as stainless steel, or the like. The thickness of the anchor section 21, the first riser section 22, the second riser section 23, the third riser section 24 and the upper section 25 preferably varies from 0.5 meter to 5 meters.

Once the apparatus 20 is constructed, the inlet valves 30 and outlet valves 32 are adjusted to equalize the pressure of the interior of the apparatus 20 with the pressure of the exterior. The pressure at different levels of the apparatus may be different during the construction phase and the final containment phase when all of the inlet valves 30 and outlet valves 32 are closed. In this manner, the equalized pressure prevents the collapse of the apparatus 20 and prevents crystallization of methane hydrates since flow of oil and sea water is constant. U.S. Pat. No. 7,441,599 for Controlling The Pressure within An Annular Volume Of A Wellbore discusses deep water pressures, and U.S. Pat. No. 7,441,599 is hereby incorporated in its entirety by reference.

Figure 8:
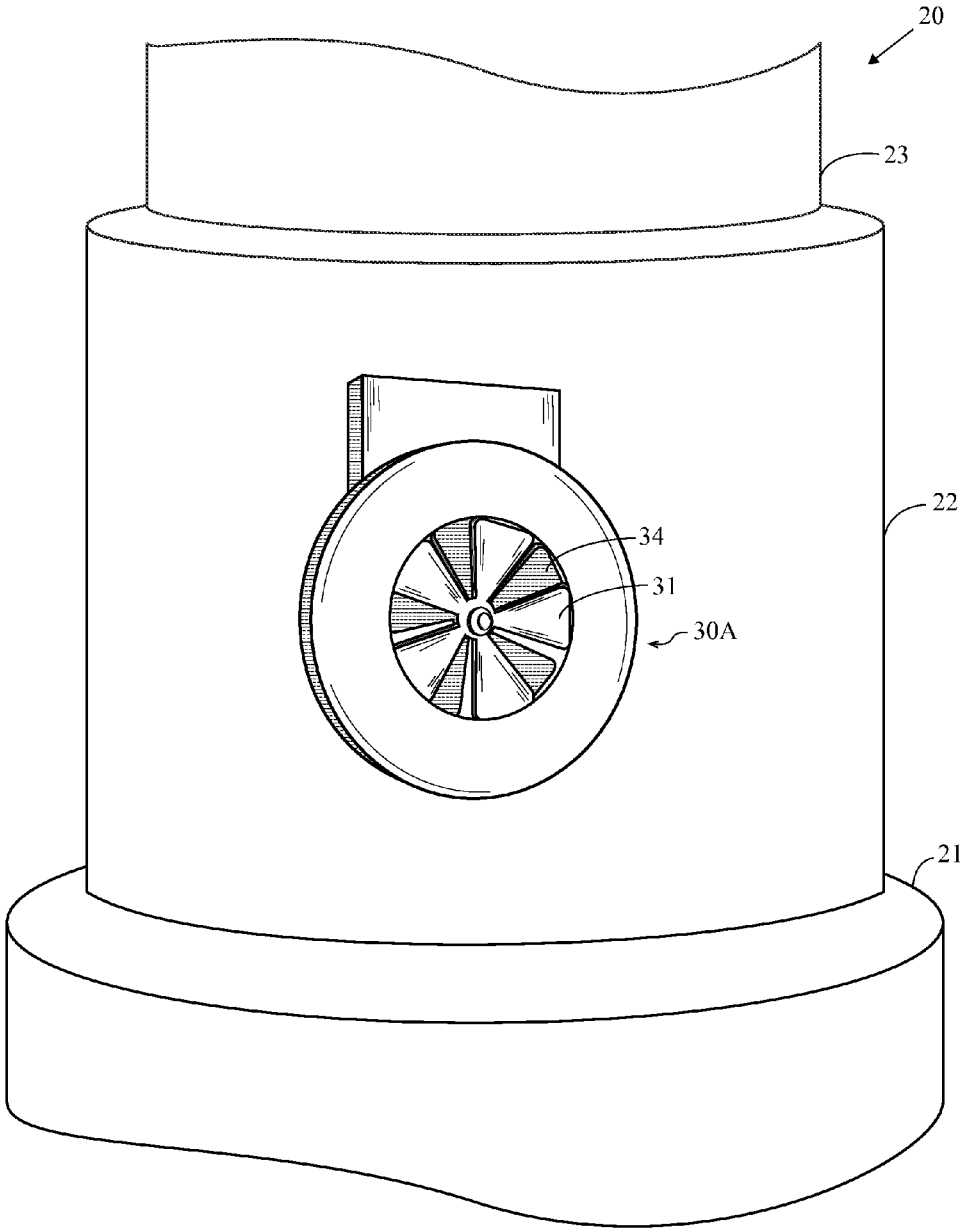
FIG. 8 is an elevational view of an inlet valve of the apparatus in a closed state.
Figure 8A:
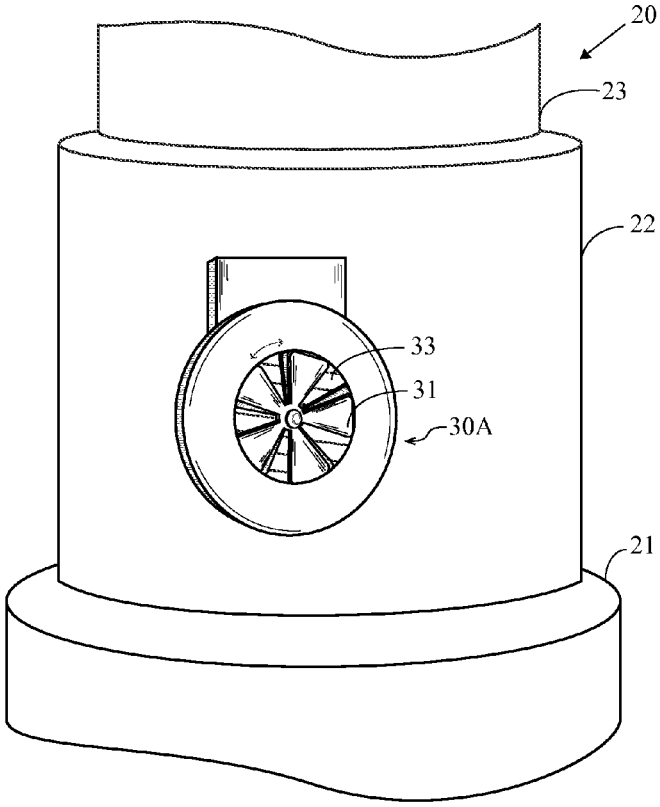
FIG. 8A is an elevational view of an inlet valve of the apparatus in an open state.
Figure 8B:
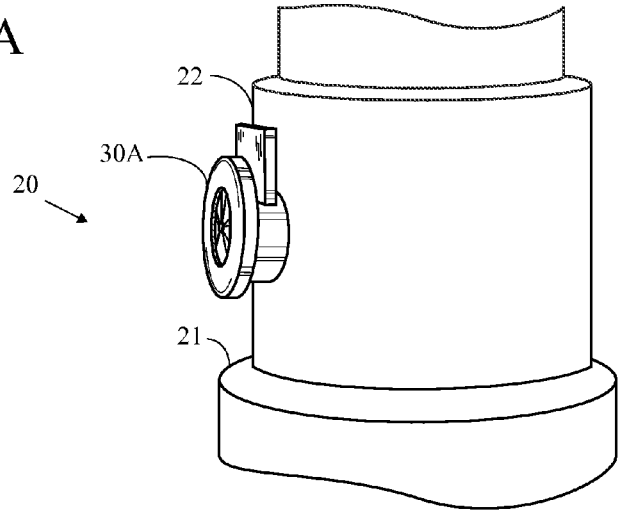
FIG. 8B is a side view of an inlet valve of the apparatus.

As shown in FIGS. 8, 8A and 8B, the inlet valve 30A has a movable valve wall 31 and a fixed valve wall 34. The valve 30A, through operation of the movable valve wall 31, can be set to a closed state, an open state or a partially open state. The inlet valve 30A is in an open state as shown in FIG. 8, with water flowing through opening 33. As shown in FIG. 8A, the inlet valve 30A is in closed state. The state of the valve 30A controls the flow of oil and water into the interior of the apparatus. Adjusting valve 30A also assists in controlling the pressure in the apparatus 20. The other inlet valves 30B, 30C and outlet valves 32A, 32B and 32C, all have similar structures and function in a similar manner. Eventually, the inlet valves 30 and outlet valves 32 are closed, which allows for most if not all of the oil 60 escaping from the oil well 50 to be suctioned through the flow tube 26 to the surface of the ocean, and eventual storage in tankers.

The apparatus is shown as having an annular or circular cross-section. However, alternative embodiments are square, rectangular, triangular or the like. The height of the apparatus preferably ranges from 5 meters to 50 meters. Further, the number of riser sections may vary from one to preferably ten, and more preferably from two to eight, and most preferably three.

The apparatus 20 is also preferably structured to sway with the currents of the water. The gaskets 36 preferably allow for the components to be flexible and shift without breaking. Thus, for example, the first riser section 22 may move laterally to the position of the anchor section 21, and the second riser section 23 may move laterally in relation to the first riser section 22. Those skilled in the art will recognize that the anchor section 21 preferably remains fixed within the ocean floor 55.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

I claim:

1. An apparatus for containing oil from a deep water oil well, the apparatus comprising:

an anchor section for anchoring the apparatus to a sea-floor, the anchor section comprising a base portion for positioning in the sea-floor and an anchor wall extending upward from the base portion, the anchor wall comprising a body with a top end;

a first gasket section mounted on the top end of the body of the anchor wall of the anchor section;

a first riser section comprising a first riser wall, a first inlet valve and a first outlet valve, the first riser wall having a body and a top end, the first inlet valve opposite the first outlet valve, the first riser section connected to the first gasket section;

a second gasket section mounted on the top end of the first riser wall;

a second riser section comprising a second riser wall, a second inlet valve and a second outlet valve, the second riser wall having a body and a top end, the second inlet valve opposite the second outlet valve, the second riser section connected to the second gasket section;

a third gasket section mounted on the top end of the second riser wall;

a third riser section comprising a third riser wall, a third inlet valve and a third outlet valve, the third riser wall having a body and a top end, the third inlet valve opposite the third outlet valve, the third riser section connected to the third gasket section;

an upper section having a base portion and an enclosure portion, the base portion mounted on the top end of the third riser wall of the third riser section, the enclosure portion having an aperture; and a flow tube in flow communication with an interior of the apparatus through the aperture of the enclosure portion of the upper section;

wherein a pressure within the apparatus is equal to a pressure outside of the apparatus, and wherein oil is suctioned from the interior of the apparatus through the flow tube.

2. The apparatus according to claim 1 further comprising a pump for suctioning the oil from the interior of the apparatus.

3. The apparatus according to claim 1 wherein each of the anchor section, the first riser section, the second riser section and the third riser section is composed of concrete.

4. The apparatus according to claim 3 wherein the upper section is composed of a stainless steel material.

5. The apparatus according to claim 3 wherein the upper section is composed of a concrete material.

6. The apparatus according to claim 1 wherein the structure has a height ranging from five meters to fifty meters.

7. The apparatus according to claim 1 wherein the structure has a diameter ranging from one meter to ten meters.

8. The apparatus according to claim 1 wherein the structure has a width ranging from one meter to ten meters.

9. The apparatus according to claim 1 wherein each of the anchor section, the first riser section, the second riser section and the third riser section has a thickness ranging from a half meter to five meters.

10. A method for constructing an apparatus for containing oil from a deep water oil well, the method comprising:

determining an anchoring position a predetermined distance from the deep water oil well, wherein the predetermined distance ranges from 2 meters to 10 meters;

anchoring an anchor section of the apparatus for containing oil from the deep water oil well in a sea floor at the anchoring position, the anchor section comprising a base portion for positioning in the sea-floor and an anchor wall extending upward from the base portion, the anchor wall comprising a body with a top end;

mounting a first gasket on the top end of the anchor wall of the anchor section;

mounting a first riser section on the first gasket, the first riser section comprising a first riser wall, a first inlet valve and a first outlet valve, the first riser wall having a body and a top end, the first inlet valve opposite the first outlet valve;

adjusting the first inlet valve and the first outlet valve to equalize a pressure within the first riser section and outside of the first riser section;

mounting a second gasket on the top end of the first riser wall of the first riser section;

mounting a second riser section on the second gasket, the second riser section comprising a second riser wall, a second inlet valve and a second outlet valve, the second riser wall having a body and a top end, the second inlet valve opposite the second outlet valve;

adjusting the second inlet valve and the second outlet valve to equalize a pressure within the second riser section and outside of the second riser section;

mounting a third gasket on the top end of the second riser wall of the second riser section;

mounting a third riser section on the third gasket, the third riser section comprising a third riser wall, a third inlet valve and a third outlet valve, the third riser wall having a body and a top end, the third inlet valve opposite the third outlet valve;

adjusting the third inlet valve and the third outlet valve to equalize a pressure within the third riser section and outside of the third riser section;

capping the apparatus with an upper section having a base portion and an enclosure portion, the base portion mounted on the top end of the third riser wall of the third riser section, the enclosure portion having an aperture in flow communication with a flow tube;

suctioning oil from an interior of the apparatus through the flow tube; and equalizing a pressure within the apparatus to a pressure outside of the apparatus by suctioning oil at a predetermined vacuum and adjusting each of the valves.

11. The method according to claim 10 wherein the deep water oil well is at least 1,500 meters below a surface of the ocean.

12. The method according to claim 10 wherein the pressure within the interior of the apparatus is at least 2000 kiloPascals.

13. The method according to claim 10 wherein a remote controlled device is utilized to construct the apparatus.

14. The method according to claim 10 further comprising closing each of the valves.

15. The method according to claim 10 further comprising closing each of the outlet valves.

* * * * *